US006120072A

United States Patent [19]

Benedict

[11] Patent Number: 6,120,072

[45] Date of Patent: Sep. 19, 2000

[54] DOORSTOP

[75] Inventor: Charles E. Benedict, Tallahassee, Fla.

[73] Assignee: Tesseract Enterprises, Inc., Tallahassee, Fla.

[21] Appl. No.: 09/340,122

[22] Filed: Jun. 28, 1999

Related U.S. Application Data

[63] Continuation-in-part of application No. 08/944,864, Oct. 6, 1997, abandoned, which is a continuation-in-part of application No. 08/517,767, Aug. 22, 1995, Pat. No. 5,673,952, which is a continuation-in-part of application No. 08/446,518, May 22, 1995, abandoned.

[51] Int. Cl.[7] ..... E05C 17/44

[52] U.S. Cl. ..... 292/338; 292/339

[58] Field of Search ..... 292/262, 288, 292/297, 338, 339, 342

[56] References Cited

U.S. PATENT DOCUMENTS

| | | | |
|---|---|---|---|
| 2,709,614 | 5/1955 | King | 292/339 |
| 4,163,574 | 8/1979 | Chezem | 292/338 |
| 4,514,000 | 4/1985 | Chezem | 292/338 |
| 4,673,203 | 6/1987 | Chezem | 292/339 |
| 5,040,835 | 8/1991 | Barker | 292/338 |
| 5,601,320 | 2/1997 | Miller | 292/343 |
| 5,673,952 | 10/1997 | Chezem et al. | 292/338 |

FOREIGN PATENT DOCUMENTS

| | | | |
|---|---|---|---|
| WO 80/00987 | 5/1980 | United Kingdom | 292/338 |

*Primary Examiner*—B. Dayoan
*Assistant Examiner*—Gary Estremsky
*Attorney, Agent, or Firm*—Dowell & Dowell, P.C.

[57] ABSTRACT

A doorstop for use with swingable doors to prevent unauthorized entry into an area which includes a brace member pivotally connected to a base. The brace has an end for engaging the floor when the doorstop is in use. An angular orientation of the brace relative to the base is controlled by a lock bar having a T-shaped head connected by a shank to an enlarged inner end which is seated in non-rotational relationship to the base after being inserted in a first orientation through aligned slots in the base and brace member and then rotated to seat within the base.

7 Claims, 3 Drawing Sheets

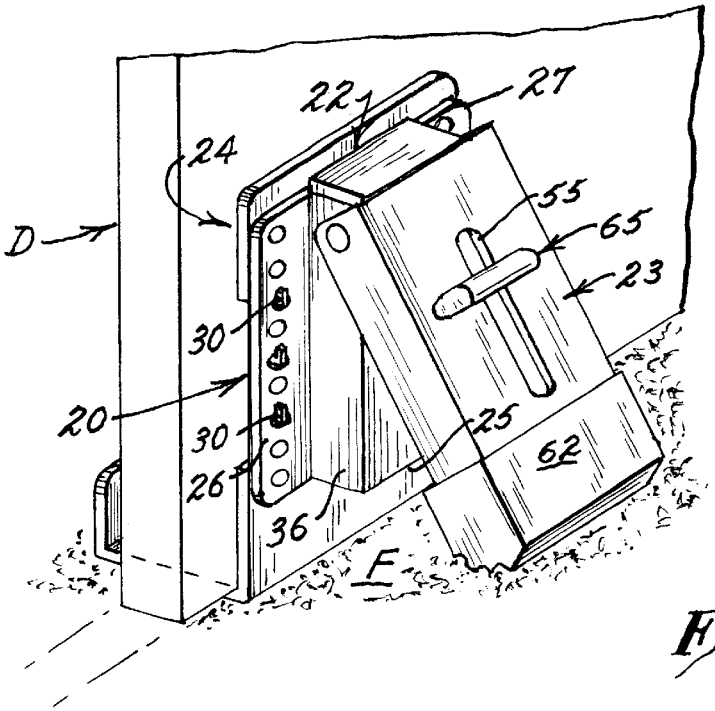
Fig.1
Fig.2
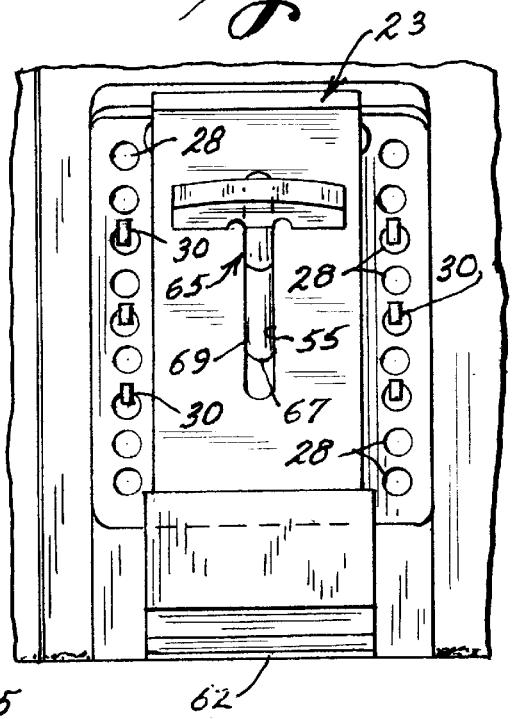
Fig.3
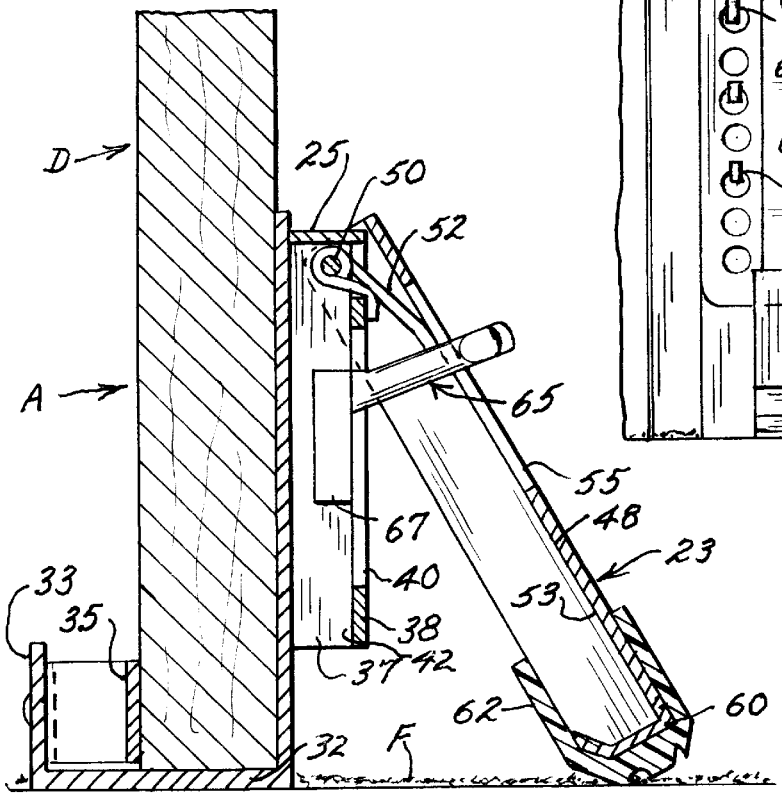

DOORSTOP

CROSS-REFERENCE TO RELATED APPLICATIONS

This application is a continuation-in-part application of U.S. Ser. No. 08/944,864 filed Oct. 6, 1997, now abandoned which is a continuation-in-part of application Ser. No. 08/517,767, filed Aug. 22, 1995, now U.S. Pat. No. 5,673,952, which is a continuation-in-part application of Ser. No. 08/446,518, filed May 22, 1995, now abandoned.

BACKGROUND OF THE INVENTION

1. Field of the Invention

The present invention is directed to a doorstop which may be used either as a fixed structure or as a portable security device on a swinging door to prevent unauthorized opening of the door when the doorstop is in an operative position.

2. History of the Related Art

Personal security is a growing concern not only in residences and offices, but also in temporary lodgings, such as hotels and motels. To increase security, many residential and commercial establishments provide security locks on doors which are operable only from within an area occupied by the occupant, tenant or guest. Security concerns are particularly important for individuals who are traveling and must normally rely on security systems and locks which are provided in the establishments they visit. Unfortunately, many such security systems or locks do not provide adequate protection and may be easily by-passed or tampered with, thereby placing individuals and their property at risk.

A number of security devices have been designed to supplement conventional locks or security systems. However, many such devices are not designed to be portable and cannot adequately be used without modification to a door or a surface such as a floor or wall adjacent to a door. Such modifications to an existing structure is impractical, especially when a lock or security device is designed to be utilized by an individual who is the guest of an establishment.

There remains a need, therefore, to provide security devices which are very compact so as to be easily portable and which also may be adjusted for use with substantially any type of swinging door. Further, there remains a need to provide such a security device that is rigid enough to perform without failure regardless of the amount of force applied to circumvent such a device.

SUMMARY OF THE INVENTION

The present invention is directed to a doorstop which may be utilized as a permanent structure or as a portable device and which includes a base which may be directly mounted to a surface of a door or to a bracket attached to a door. A brace member or leg is pivotally connected to the base and extends downwardly to a boot which is provided for increasing frictional resistance between the doorstop and a floor to which the boot is engaged when the doorstop is in use. To orient the brace member or leg so that the boot engages the floor at a proper angle or position to prevent unauthorized opening of the door, a lock bar is provided which extends from the front face of the brace member through an elongated slot therein and through a corresponding and aligned slot in the base, to an enlarged inner end which extends outwardly so as to engage substantially flat against a rear surface of a housing defined by the base on opposite sides of the slot therein with the sides of the inner end portion proximate to the sides of the housing. The lock bar also includes an outer end or head portion including outwardly extending flange elements including inner curvilinear surfaces or edges which engage the front surface of the brace member on opposite sides of the slot therein.

The lock bar is designed to be easily installed between the brace member and the base and disassembled to facilitate storage and shipment. The lock bar includes a shank which extends from the head portion to the inner end portion and which is configured so as to permit the inner end portion to be inserted through the aligned slots in the brace member and the base and, thereafter, the lock bar rotated so that the inner and outer end portions extend generally horizontally outwardly and on opposite sides of the slots in the brace member and the base of the doorstop, respectively. When installed, the configuration of the inner portion of the lock bar will prevent any rotational movement of the lock bar relative to the brace member and base. Also, the angle and geometry of the inner end of the lock bar and the curvilinear portions of the outer end of the lock bar, ensure that the lock bar will be retained in a predetermined adjusted position after the brace member is extended into a deployed position, regardless of the amount of force which is applied to a door when the doorstop is in use.

It is the primary object of the present invention to provide a doorstop which may either be permanently secured to a swinging door or may be portable and easily attached to a door without the use of tools and which will provide sufficient security to prevent unauthorized opening of the door whenever the doorstop has been placed into use, regardless of the amount or type of force placed upon the door to defeat the doorstop.

It is another object of the present invention to provide a portable doorstop having a lock bar incorporated therewith which can be easily assembled and disassembled with respect to a base and a brace member so as to allow the components to be compactly stored for ease of portability or shipment and wherein the lock bar effectively prevents unauthorized tampering of the doorstop after the doorstop has been placed into an operative position.

BRIEF DESCRIPTION OF THE DRAWINGS

FIG. 1 is a perspective illustrational view of the doorstop of the present invention showing the base mounted to a separate mounting bracket engageable with the lower portion of a door without the use of tools;

FIG. 2 is a front elevational view of the doorstop of FIG. 1;

FIG. 3 is an enlarged cross-sectional view taken along line 3—3 of FIG. 2;

DESCRIPTION OF THE PREFERRED EMBODIMENT

Figure 4:
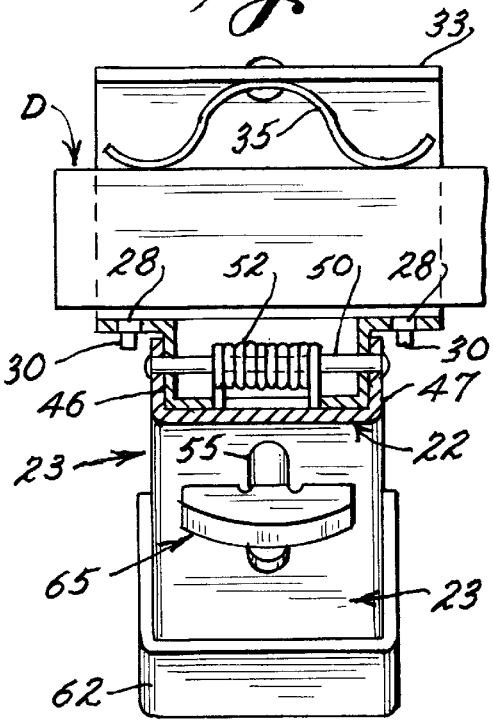
FIG. 4 is a cross-sectional view taken along line 4—4 of FIG. 2.

With continued reference to the drawing figures, the doorstop 20 of the present invention is shown mounted to the lower portion of a swingable door "D". The doorstop includes a base 22 having a leg or brace member 23 pivotally mounted thereto. In the embodiment shown, the base 22 is supported on a separate mounting bracket 24 by way of which the doorstop may be secured to the door without the use of tools. It should be noted that the present invention is also directed to structures which may be permanently secured to a door using screws, bolts or other fasteners. In such embodiments, the separate mounting bracket 24 is not used.

Figure 5:
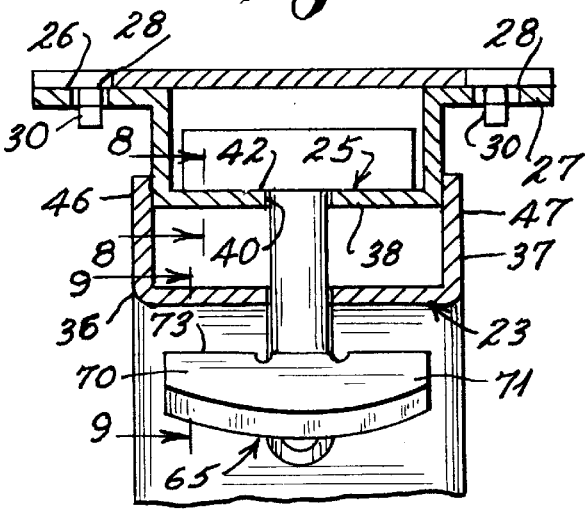
FIG. 5 is a cross-sectional view taken along line 5—5 of FIG. 3.
Figure 6:
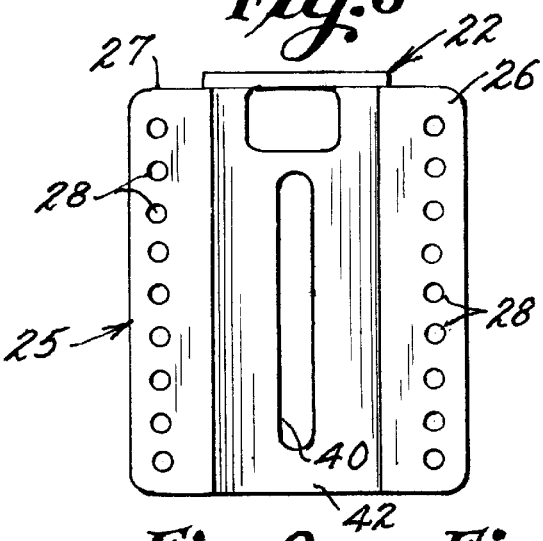
FIG. 6 is a rear view of the base of the doorstop shown in FIG. 1.
Figure 7:
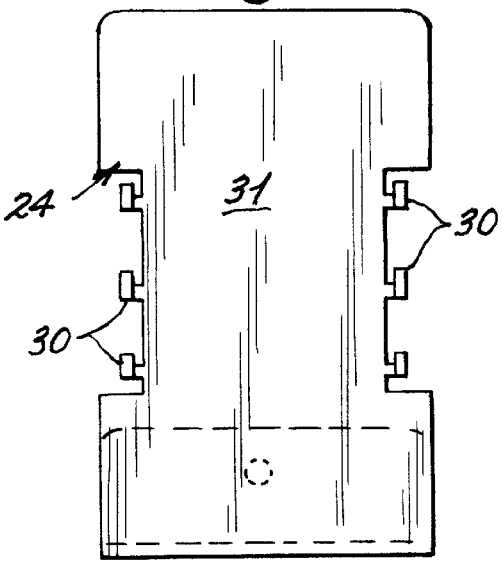
FIG. 7 is a front plan view of a portable bracket member for supporting the base of the doorstop shown in FIG. 1.
Figure 8:
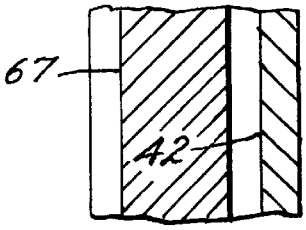
FIG. 8 is an enlarged cross-sectional view taken along line 8—8 of FIG. 5.

The base defines a housing 25 which is generally U-shaped in cross-section, as shown in FIG. 5, having flanges 26 and 27 extending outwardly therefrom. Each flange has a plurality of vertically spaced openings 28 therethrough. Fasteners may be positioned through the vertically spaced openings to secure the base to the rear surface of a door or the openings may be used to receive two or more studs 30 which extend outwardly from a backplate 31 of the mounting bracket 24, as shown in FIG. 7. It should be noted that the studs are somewhat L-shaped in configuration in order to provide a vertically upstanding portion for preventing the base from being accidentally dislodged from supporting engagement with the studs. The spaced openings 28 enable the base to be vertically positioned at different heights relative to the bottom edge of the door "D" and from a floor "F".

The backplate 31 is designed to engage the rear surface of the door, as shown in FIG. 1. The backplate is integrally formed with a bottom wall 32 and a forward upwardly extending flange 33. A double arm spring 35 is riveted or otherwise secured to the flange 33 and extends between the flange and the front surface of the door to thereby secure the mounting bracket to the door. Other types of mounting brackets or clamping devices may be utilized such as are disclosed in U.S. Pat. No. 5,673,952, the contents of which are incorporated herein and by reference.

As previously noted, the housing 25 of the base is U-shaped having opposing side walls 36 and 37 and front wall 38. The front wall 38 has an elongated vertical slot 40 extending therethrough from the front wall to a rear surface 42 thereof. The housing is preferably is formed of a metal material.

The leg or brace member 23 is also generally U-shaped in cross-section as shown in FIGS. 4 and 5 and includes opposite side walls 46 and 47 which are integrally formed of a metallic material with a front wall 48. As shown, the side walls 46 and 47 are spaced from one another a distance slightly greater than the distance between the side walls 36 and 37 of the housing 25 of the base 22 so that the leg or brace member 23 is seated over the housing 25. As previously mentioned, the brace member 23 is pivotally mounted to the base. As shown in FIG. 4, a pivot pin 50 extends through appropriately aligned openings in each of the side walls 36 and 37 of the base and aligned openings in the side walls 46 and 47 of the brace member. A coil or torsion spring 52 is mounted about the pivot pin and has end portions which engage the rear surface 53 of the front wall 48 of the brace member. The spring 52 thereby normally applies a force to urge the brace member outwardly at an angle relative to the base, as shown in FIGS. 1 and 3.

The brace 23 also includes an elongated slot 55 through the front wall 48 thereof which is generally aligned with the slot 40 in the base 22. The brace member 23 is designed to prevent the unauthorized opening of the door "D" in the direction of the arrow "A" shown in FIG. 3. In this respect, the lower end 60 of the brace is covered with a boot 62 which is preferably formed of a somewhat resilient material, such as rubber, which will act to firmly frictionally engage different types of floor surfaces such as tile or wood, as well as floor coverings such as rugs and carpeting, without damaging such surfaces or coverings. The boot functions to frictionally bind the brace against the floor or floor covering so that no slippage will occur when a force is applied to the front of the door in the direction of the arrow "A" in FIG. 3.

In order for the doorstop of the present invention to be properly deployed to ensure security and prohibit any opening of a door when in use, it is important that the brace 23 is properly inclined and retained in an angular relationship with respect to the base, as illustrated in FIGS. 1 and 3 of the drawing figures. To accomplish this, the present invention incorporates a lock bar 65. The lock bar 65 includes a head or outer end portion 66 which is integrally connected to a base or inner end portion 67 by a shank 68. The configuration of the lock bar 65 is such as to allow the lock bar to be selectively disengaged from the base 22 and the brace 23 to permit compact storage of the doorstop to facilitate portability. The structure is further designed such that when the lock bar is in place, as shown in FIG. 3, it is not possible to disengage the lock bar from a locked position by applying a force to open a door against the door stop and thus the lock bar ensures that the brace member 23 is retained in a preselected angular relationship so that the boot 62 associated therewith makes proper frictional engagement to prevent any opening of the door "D".

Figure 9:
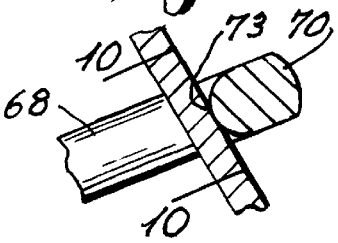
FIG. 9 is an enlarged cross-sectional view taken along line 9—9 of FIG. 5.
Figure 10:
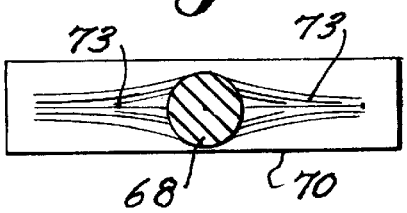
FIG. 10 is a cross-sectional view taken along line 10—10 of FIG. 9.
Figure 11:
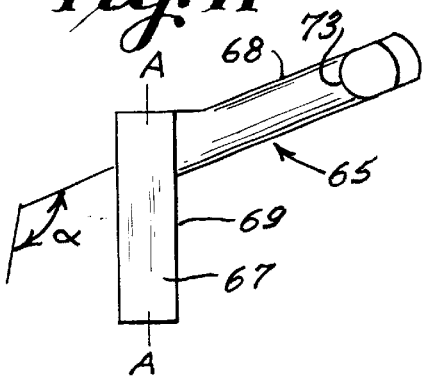
FIG. 11 is a right side view of the lock bar of the doorstop of FIG. 1.
Figure 12:
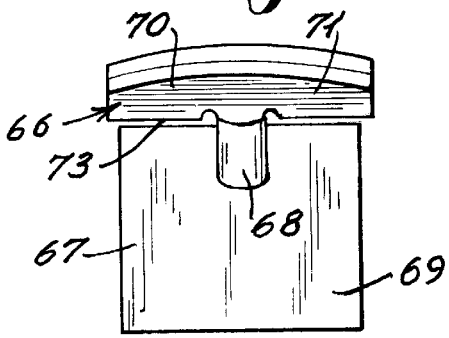
FIG. 12 is a front elevational view of the lock bar shown in FIG. 1.

As shown in FIGS. 1–5, the outer end portion 66 of the lock bar is generally T-shaped in configuration such that the outer end portion has segments 70 and 71 which extend outwardly on opposite sides of the slot 55 in the brace 23. The segments include inner curvilinear edges 73 (see FIG. 9) which are engageable with the front surface of the brace. The inner end portion 67 of the lock bar 65 extends downwardly with respect to an inner end of the shank 68 and serves as a counterweight for normally pivoting the lock bar to the position shown in FIG. 3 when the lock bar is placed into use. In this respect, the inner end portion 67 is larger than the outer end portion. The inner end portion includes an enlarged face 69 which engages the inner surface of the base housing on opposite sides of the slot 40 therein and with the sides of the inner end portion proximate to the sides of the housing. This engagement, together with the engagement between the inner curvilinear edges of the outer end portion and the front surface of the brace member, will ensure that the lock bar is securely retained in a deployed position, as shown in FIG. 3, when the brace member is set to a predetermined angle relative to the base. The deployment of the brace is retained until a force is applied upwardly against the outer end portion of the lock bar to thereby release the lock bar from a locked engagement with the brace.

Figure 13:
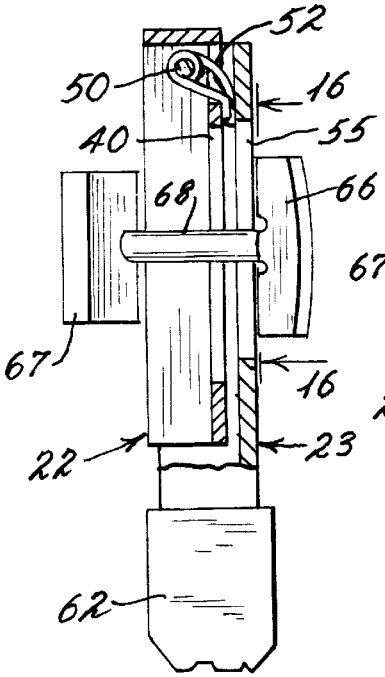
FIG. 13 is a cross-sectional illustrational view having portions broken away showing the lock bar of the embodiment shown in FIG. 1 rotated approximately 90° to allow an inner end portion thereof to be inserted through aligned slots in the brace member and base of the doorstop.
Figure 14:
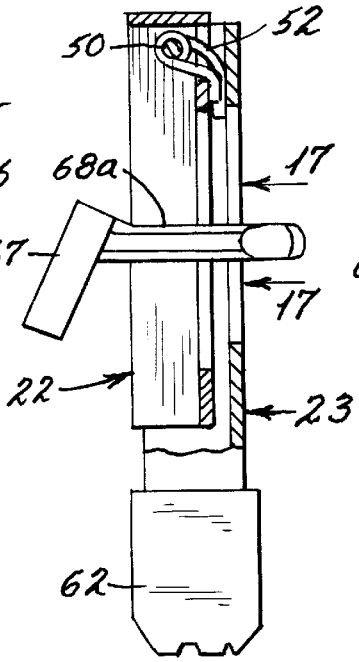
FIG. 14 is a view similar to FIG. 13 showing the lock bar rotated toward a normal locking position relative to the brace member, with the brace member pivoted so as to allow vertical adjustment of the lock bar relative thereto.
Figure 15:
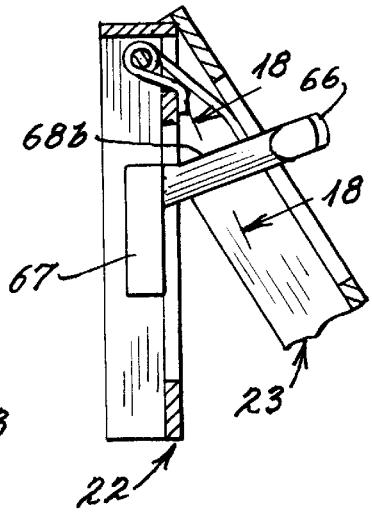
FIG. 15 is a view similar to FIGS. 13 and 14 showing the lock bar in a locking position with respect to the brace member which extends at an angle relative to the housing portion of the base of the doorstop.
Figure 16:
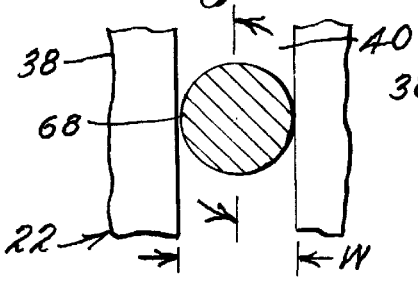
FIGS. 16 is a cross sectional view taken generally along lines 16—16 of FIG. 13 showing a first cross sectional configuration of a shank of the lock bar shown in FIG. 13.
Figure 17:
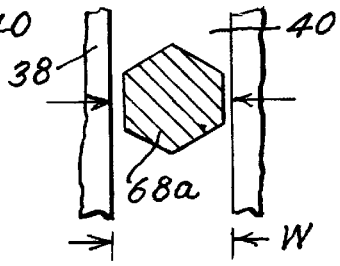
FIG. 17 is a cross sectional configuration of an alternate shank as shown in FIG. 14.
Figure 18:
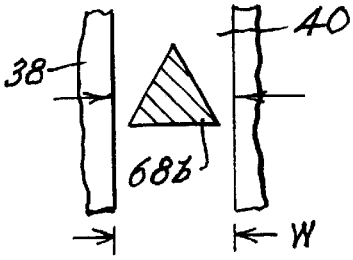
FIG. 18 is a cross sectional configuration of another shank as shown in FIG. 15.

With respect to FIGS. 11–18, the manner in which the lock bar 65 of the present invention is inserted between the brace 23 and the base 22 is illustrated. It should be noted that different cross sectional embodiments are illustrated for the shank of the lock bar in FIGS. 13–15 and 16–18, respectively. The brace is moved to the position shown in FIG. 13 wherein the brace is generally parallel with respect to the base such that the slots 55 and 40 thereof, respectively, are aligned with one another. The slots define an opening of a width "W", as shown in FIGS. 16 and 18, which is substantially equal to the maximum width dimension of the shanks 68, 68*a* and 68*b*. By turning the lock bar approximately 90° relative to the installed position shown in FIG. 15, the inner end portion 67 thereof is inserted through the aligned slots 55 and 40. Thereafter, the lock bar is rotated, as shown in FIG. 14. The length of each of the shanks is sufficient to allow the shanks to be rotated within both of the openings 55 and 40 of the brace member and the base simultaneously, as shown in FIGS. 13 and 14. Thereafter, by releasing the brace 23 and allowing it to extend outwardly under the influence of the torsion spring 52, the brace member 23 is deployed to the position shown in FIG. 15.

With particular reference to FIGS. 11–15, it is noted that the inner end portion 67 of the lock bar extends at an angle a with respect to the shank 68. The angle a is greater than approximately 90° and less than approximately 180° and preferably between 110° and 140°. Further, the curvilinear inner edge or surface portions 73 of the outwardly extending segments 70 and 71 of the outer end portion of the lock bar are also oriented at the angle $\alpha$ relative to the elongated axis A—A of the inner end of the lock bar. This angular relationship ensures that when the front face 69 of the inner end portion of the lock bar is in flush engagement against the inner surface 42 of the housing defined in the base and with the curvilinear edge portions of the outer segments of the outer end portion of the lock bar engaging the outer surface of the brace, as shown in FIG. 15, it is not possible for the brace 23 to move outwardly relative to the base, unless the outer end portion of the lock bar is physically raised, thereby sliding the entire locking bar assembly relative to the slots within the brace member and the base. In this respect, it should be noted that the inner end portion need not strictly hang down relative to the shank, but may also be equally distributed above the shank.

To further rigidify the doorstop, the width of the inner end portion 67 of the lock bar is preferably substantially equal to the spacing between the side walls 36 and 37 of the housing 25 of the base 22 to thereby prevent rotation therebetween when the lock bar is installed to the base, as shown in FIG. 5.

As opposed to the shank being formed in a round or oval cross sectional configuration, other configurations, such as shown in FIGS. 17 and 18, maybe used. Variable cross sections of the shank may also be used.

With particular reference to FIG. 14, it is noted that the lock bar is installed to the base and brace member prior to being connected to the bracket 24. Therefore, when the inner end portion of the lock bar is inserted between the aligned slots in the brace and the base, the end portion is extended beyond the housing of the base at which point the inner end portion may be positioned between the side walls 36 and 37 of the housing 25.

In use of the doorstop of the present invention, the brace member 23 is aligned in the position shown in FIG. 13 relative to the front surface of the base so that the slot 55 is aligned with slot 40 in the base. Thereafter, the lock bar is inserted by extending the inner end portion 67 thereof through the aligned slots and then rotating the lock bar 90°, as illustrated in FIGS. 13 and 14. Thereafter, the torsion spring will extend the brace member outwardly from the base 22. The base 22 is then either directly secured to the rear surface of a door "D" or the mounting bracket 24 is mounted to the door, as previously described, and the base suspended therefrom utilizing the openings 28 in the flanges 26 and 27. Depending upon the required adjustment, the lock bar 65 may be raised relative to the slots 55 and 40 until the brace member 23 is correctly engaged such that the boot 62 associated therewith is engaged with the floor or floor covering surface, as shown in FIG. 3. Thereafter, the lock bar is vertically dropped to a position, also shown in FIG. 3, wherein the inner end portion thereof will engage the inner surface of the base with the curvilinear edges of the outer end portion engaging the front surface of the brace on opposite sides of the slot 55, thus binding the lock bar relative to the brace member and the base.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

What is claimed is:

1. A doorstop for use on a door having an inner surface and an outer surface and which is disposed above a floor, the doorstop comprising:

a base having an outer wall with a first slot therethrough between an inner and an outer surface of said outer wall;

means adapted to mount said base relative to the inner surface of the door;

a brace member including a wall having a second slot therethrough, an upper portion and a lower end, said upper portion being pivotally connected to said base about a pivot axis such that said brace member is pivotable to an operative position in which said lower end extends outwardly relative to said base so as to be engageable with the floor; and a lock bar including an outer end portion and an enlarged inner end portion which are connected by an integral shank, said inner end portion being disposed downwardly at an angle greater than approximately 90° and less than approximately 180° with respect to said shank, said inner end portion being of a size to be insertable through said first and second slots and thereafter rotated so that a front face thereof is engageable in substantially flush engagement with said inner surface of said outer wall of said base on opposite sides of said slot therein, said outer end portion extending outwardly on said opposite sides of said second slot and having curvilinear edges for engaging a front surface of said wall of said brace member when said brace member is in the operative position, and said shank having a cross-sectional configuration such that said shank is rotatable within said first and second slots to thereby allow said inner end portion of said lock bar to be inserted through said first and second slots.

2. The doorstop of claim 1 in which said base includes a housing having opposing side walls spaced a first distance with respect to one another by said outer wall, said inner end portion of said lock bar having opposite edges which are spaced proximate to and between said side walls of said housing whereby said inner end portion of said lock bar is non-rotatably seated intermediate said opposing side walls of said housing when said brace member is in the operative position.

3. The doorstop of claim 2 including means for resiliently biasing said brace member outwardly away from said base toward the operative position.

4. The doorstop of claim 1 wherein said angle is between approximately 110° to 140°.

5. A doorstop for use on a door having an inner surface and an outer surface and which is disposed above a floor, the doorstop comprising:

a base having an outer wall with a first slot therethrough between an inner and an outer surface of said outer wall;

means adapted to mount said base relative to the inner surface of the door;

a brace member including a wall having a second slot therethrough, an upper portion and a lower end, said upper portion being pivotally connected to said base about a pivot axis such that said brace member is pivotable to an operative position in which said lower end extends outwardly relative to said base so as to be engageable with the floor; and a lock bar including an outer end portion and an enlarged inner end portion which are connected by a shank, said inner end portion being disposed downwardly at an angle greater than approximately 90° and less than approximately 180° with respect to said shank, said inner end portion being of a size to be insertable through said first and second slots and thereafter rotated so that a front face thereof is engageable in substantially flush engagement with said inner surface of said outer wall of said base on opposite sides of said slot therein, said outer end portion extending outwardly on said opposite sides of said second slot and having curvilinear edges for engaging a front surface of said wall of said brace member when said brace member is in the operative position, and said shank having a cross-sectional configuration such that said shank is rotatable within said first and second slots to thereby allow said inner end portion of said lock bar to be inserted through said first and second slots.

6. The doorstop of claim 5 in which said base includes a housing having opposing side walls spaced a first distance with respect to one another by said outer wall, said inner end portion of said lock bar having opposite edges which are spaced proximate to and between said side walls of said housing whereby said inner end portion of said lock bar is non-rotatably seated intermediate said opposing side walls of said housing when said brace member is in the operative position.

7. The doorstop of claim 6 wherein said outer end portion includes outwardly extending segments each having a curvilinear edge for engaging said front surface of said wall of said brace member in the operative position.

* * * * *